United States Patent [19]

Berkenblit et al.

[11] 4,018,490

[45] Apr. 19, 1977

[54] GAS DISCHARGE DISPLAY PANEL FABRICATION

[75] Inventors: Melvin Berkenblit, Yorktown Heights; Robert O. Lussow, Hopewell Junction; Kyu Chang Park; Arnold Reisman, both of Yorktown Heights, all of N.Y.

[73] Assignee: International Business Machines Corporation, Armonk, N.Y.

[22] Filed: July 7, 1975

[21] Appl. No.: 593,618

[52] U.S. Cl. ..... 316/21

[51] Int. Cl.[2] ..... H01J 9/38

[58] Field of Search ..... 316/17, 18, 19, 20, 316/21

[56] References Cited

UNITED STATES PATENTS 3,778,126 12/1973 Wilson ..... 316/20

OTHER PUBLICATIONS

B351,672, Jan. 1975, Beckerman et al., 316/20.

*Primary Examiner*—Richard B. Lazarus
*Attorney, Agent, or Firm*—John A. Jordan

[57] ABSTRACT

An in situ process is disclosed for fabricating gas discharge display panels in a sequential seal, bake-out and backfill mode of operation. The single thermal cycle process involves placing unassembled panel parts in a controlled gas ambient furnace system with required seal frame, evacuating said furnace and backfilling with an appropriate ambient atmosphere to an appropriate pressure while heating the furnace. During the heating, the furnace is repeatedly evacuated to moderate vacuum and refilled to some predetermined pressure. The furnace is heated to just above the glass transition temperature of the seal frame in this evacuate-refill mode, then held for some time to achieve outgassing of both panel parts and furnace chamber. Thereafter, the furnace chamber is refilled to one atmosphere and further heated to complete the sealing of the panel. The panel is then cooled to approximately 300° C, still under one atmosphere, after which the evacuate-refill cycle is continuously repeated as the temperature is lowered down to the temperature of tip-off using the refill gas for the pressurization. The panel is refilled to an appropriate pressure at elevated temperature such that at room temperature the pressure is the desired pressure and the panel is tipped off. The process of successive evacuations and backfillings at the appropriate portions of the cycle are highly desirable for cleaning of the panel parts via contaminant dilution.

19 Claims, 2 Drawing Figures

FIG. I
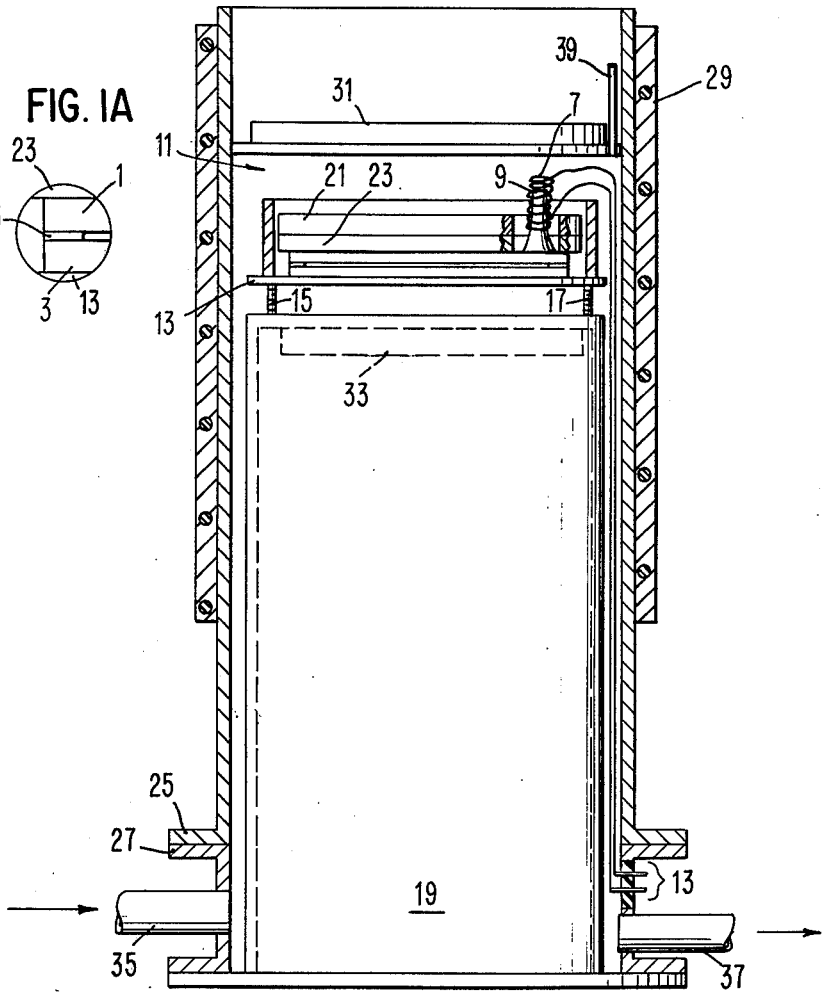
FIG. IA

GAS DISCHARGE DISPLAY PANEL FABRICATION

BACKGROUND OF THE INVENTION

1. Field of the Invention

The present invention relates to fabrication processes for fabricating gas discharge display panels, and more particularly, to sequential, in situ fabrication processes for the fabrication of gas discharge display panels.

2. Description of the Prior Art

One of the difficulties encountered in gas panel fabrication processes resides in the fact that, in general, such processes involve a multiplicity of steps which are somewhat cumbersome and require separate handling operations. Such operations, of course, are costly. More importantly, however, is the fact that separate handling operations tend to introduce inpurities and foreign matter into the panel which impurities and foreign matter act to cause the panel operation to be nonoptimal. As is evident, the more the separate handling operations involved, the greater the likelihood that the resultant fabricated display will not exhibit acceptable operating characteristics or long-life, or operate satisfactorily. Accordingly, it is quite apparent that any process which tends to eliminate or combine steps such that the member of separate handling operations is reduced is a significant contribution to the overall objective of producing panels which are reliable and acceptable, i.e., increasing yield.

One of the particular problems encountered in the fabrication of AC gas panel display devices resides in the fact that the layer of refractory material whose secondary electron emission charcteristics are important to device operation and which is deposited upon the dielectric material covering the panel conductive lines is, often, quite active chemically. For example, MgO, which is a desirable secondary electron emitter material, is quite reactive with water and carbon dioxide. In this regard, it is known that the electrical properties of the gas panel are affected by exposure to $H_2O$ and $CO_2$. It is evident, that other elements and compounds may likewise act to affect the electrical properties of gas panels. Thus, it is quite important in fabricating gas panels to eliminate or minimize any possibility of exposure of the active region of the panel to impurities such as $H_2O$ and $CO_2$, particularly during cooling of the fabricated part.

In the usual mode of fabricating gas panels, the panel, after having been sealed in air, must be baked out under vacuum for an extended period of time in a separate step in order to decompose or deadsorb reacted or adsorbed foreign species upon the panel interior surfaces. Thereafter, the panel is backfilled with the desired gas mixture to approximately 400 torr, generally at room temperature or thereabouts, and then the panel is finally tipped off. Unfortunately, such vacuum bake-out is generally not sufficient to remove the contaminants completely, and the panel must then undergo extensive electrical burn-in, which involves setting up a discharge in order to attain specified and stable operating characteristics. The difficulties with such a process are many. For example, the separate process step of sealing the panels in air tends to cause many of the panels so produced to be unacceptable. The exact reasons for this are not completely understood, but for one it can be conjectured that room air ambient, which includes $CO_2$ and $H_2O$, tends to introduce impurities into the panels so fabricated.

One prior art gas panel fabrication process which endeavored to simplify the above-mentioned process is that described by Wilson in U.S. Pat. No. 3,778,126. Wilson describes an in situ process whereby Wilson attempts to eliminate separate manipulation of the panel for the evacuation and backfilling operations by utilizing a single vacuum oven enclosure for the process. Wilson seals the gas panel within the oven enclosure, filled with a neon/argon gas mixture. Since it is Wilson's prime objective to eliminate the panel tubulation, when the Wilson panel is sealed in the neon/argon environment, the panel has permanently sealed therein the gas mixture to be used for gas discharge operations.

One of the difficulties with Wilson, however, resides in the fact that, although the panel is simply sealed in a neon/argon environment thereby, in theory at least, eliminating bake-out and backfill, the panels so produced still contain contamination even though sealed in a neon/argon environment. This is due to the fact that the single initial pump-down of Wilson is apparently not sufficient to eliminate all impurities. Moreover, during the sealing process, there apparently is a considerable amount of out-gassing of impurities from the various panel materials utilized in its fabrication and from the vacuum chamber. These out-gassed impurities are, then, permanently sealed into the panels produced by the Wilson process.

A further difficulty with the Wilson process resides in the fact that Wilson describes backfilling the evacuated enclosure with neon/argon to approximately 1 atmosphere at room temperature in an apparently closed system. Pressures of approximately 1 atmosphere at room temperature in a closed system produce pressures which are much too high and therefore ineffective for efficient gas discharge display operation at normal sealing, i.e., fusing temperatures (e.g. 500° C), wherein the neon/argon is permanently encapsulated in the panels. As can be seen, since the temperature at which the Wilson panel is permanently encapsulated is fixed by the sealing temperature, room temperature pressure for the panels of Wilson can only be selected by appropriate control of pressure within the enclosure at sealing temperature. In the present invention, the panel sealing, i.e., plate sealing, may be accomplished at one atmosphere gas pressure, for example, independent of the final encapsulated neon/argon pressure for the panel. The encapsulated neon/argon pressure of the panel at room temperature can be controlled by both the tip-off temperature and tip-off pressure.

In addition to the mentioned pressure-temperature difficulties, it has been found that, in practice, the burn-in step purportedly eliminated by the Wilson process is, in fact, necessary to produce acceptable panels fabricated by the Wilson process. Finally, it should be noted that the Wilson purpose of eliminating the tubulation step typically employed in the prior art has one further disadvantage. That disadvantage is that, since the surface/volume ratio of gas panels is large and the absolute volume is small, the tubulation structure itself typically acts to provide a ballast, i.e., additional volume diluting any contamination trapped in the panel. Panel lifetime may be shortened without this ballast.

SUMMARY OF THE INVENTION

In accordance with the principles of the present invention, a fabrication process for fabricating gas discharge display panels is provided which process acts to simplify the known prior art processes and yet acts to permit panels to be produced in higher yield and with improved operating characteristics. In its simplest terms, the process involves an in situ sequential seal, bake-out and backfill operation arranged to eliminate manipulation and handling of panel parts during fabrication, and at the same time reduce and eliminate certain impurities and contaminants which would otherwise be introduced into the panel during the fabrication. Basically, the process involves sealing unassembled gas panel parts in an appropriate, controlled, gas ambient to produce in a single thermal cycle acceptable panels.

The panel parts, in unassembled form, are positioned within the gas ambient system chamber in a manner so that they may be fused together upon application of sufficient heat. Conventional tubulation is provided on at least one of the glass plates of the panel, and a platinum or other suitable wire coil or heating element is placed in position around the tubulation for tip-off. The system chamber is then pumped down using, for example, a sorption pump, or the like. A purified gas mixture, for example purified air, is then used to partially fill the system. Thereafter, the chamber is heated to between approximately 420° C to 460° C, for example, and held at this temperature. During this time, the chamber is alternately evacuated and refilled to a partial gas pressure and outgassing products from the chamber and panel parts are effectively removed. Then, the chamber is filled to one atmosphere and heated up to approximately 500° C at a rate of approximately 100° C per hour, for example, and held for approximately one hour, for example, to complete the sealing of the panel. Thereafter, the chamber is cooled, typically to 300° C, and the chamber is then alternately evacuated and partially refilled with neon/argon typically neon-0.1% argon. This cleaning procedure is continued while the temperature is reduced until a predetermined temperature is reached. Neon/argon pressure is adjusted and the tip-off is then effected by activating the platinum coil. The temperature and pressure at tip-off is determined by the desired pressure in the panel at room temperature.

It is, therefore, an object of the present invention to provide an improved process for fabricating gas discharge display panels.

It is, therefore, a further object of the present invention to provide an in situ sequential process for fabricating gas discharge display panels which is simple, and yet produces panels which are relatively free from impurity and contamination.

It is a further object of the present invention to provide a process for fabricating gas discharge display panels which tends to increase the productivity yield in the fabrication of such panels and, at the same time, improve the operating characteristics of panels so fabricated.

It is yet another object of the present invention to provide an improved process for fabricating gas discharge display panels during a single thermal cycle.

It is yet still another object of the present invention to provide a process for fabricating gas discharge display panels which acts in situ, in a single thermal cycle, to sequentially seal, bake out and backfill gas discharge panels in a simple and efficient operation.

The foregoing and other objects, features and advantages of the invention will be apparent from the following more particular description of preferred embodiments of the invention, as described in conjunction with the accompanying drawing.

BRIEF DESCRIPTION OF THE DRAWING

FIG. 1 shows one embodiment of a controlled gas ambient furnace system which may be utilized in carrying out the process in accordance with the principles of the present invention.

FIG. 1A shows an exploded view of the manner in which a seal frame separates the glass plates of the gas panel shown in FIG. 1.

DESCRIPTION OF THE PREFERRED EMBODIMENTS

The various structural configurations of gas discharge display panels are well known to those skilled in the art. Typically, the AC gas discharge display panel comprises a pair of glass plates, such as conventional plate glass, upon which has respectively been deposited sets of parallel conductive lines. A layer of transparent dielectric material, such as glass, is used to cover each of these sets of conductive lines, and a material whose secondary electron emission characterictics are desirable, such as MgO, is used to coat the dielectric material. The plates are positioned, in spaced-apart relationship, so that the sets of parallel conductive lines are orthogonal to one another, and then the plates are sealed together.

Arrangements akin to that described above are replete in the prior art. For example, the above-mentioned Wilson U.S. Pat. No. 3,778,126 describes a gas panel assembly somewhat akin to that described herein. However, the Wilson patent does not describe the use of MgO. Likewise, U.S. Pat. No. 3,862,831 to Berkenblit et al. entitled "Glass Fabrication Process" describes a gas panel assembly the same as that hereinabove mentioned. It should be noted, in this regard, that when sealing gas panel display devices, the seal may be made directly to the dielectric layer as described in the Berkenblit et al. patent. Alternatively, a "direct seal" technique may be employed whereby the seal is made directly to the parallel conductive lines and the underlying substrate plate glass. Examples of such an assembly are described in two articles appearing in the Mar. 10, 1975 IBM Technical Disclosure Bulletin, Vol. 17, No. 10. The first article is entitled "Making Gas Panel Displays" by J. Landermann et al. and appears at pages 3136 and 3137, and the second article is entitled "Gas Panel Structure to Allow Direct Seals to Submerged Metallurgies" by A. Reisman and appears at pages 3138 and 3139.

Although the exact structure of the AC gas panel assembly fabricated in accordance with the principles of the process of the present invention is not critical, it is assumed for the sake of description of the process that the gas panel assembly being fabricated is akin to that described either by Berkenblit et al. or Landermann et al. Insofar as the essential features of the process of the present invention are concerned, all that need be viewed is a pair of glass plates (one of which has tubulation) arranged so that a seal frame and suitable spacers separate them. Seal frames are well known to those skilled in the art. Basically, the seal frame comprises a frame of suitable solder glass or other sealant material which is to circumscribe the active gas discharge region between the pair of plates. This is more clearly shown in FIG. 1A wherein glass plates 1 and 3 are separated by seal frame 5. As hereinabove mentioned, each of plates 1 and 3 typically have deposited thereon sets of parallel conductors coated with a dielectric glass which is in turn coated with a layer of material, such as MgO.

With further reference to the controlled gas ambient furnace system shown in the FIGURE, it should be noted that in accordance with the process of the present invention, a heating element or coil 7 is shown in position around panel tubulation 9. As will be more evident from the ensuing description of the process, tubulation 9 acts to permit the entry and exhaust of gases, impurities, etc. during the successive evacuations and backfills of chamber 11. Heating element 7 may comprise, for example, a platinum wire coil which circumscribes the tubulation. The platinum coil is powered by a low voltage-high current supply (not shown) connected to the terminals shown at 13. Typically, a 10 volt-25 amp supply would be adequate to quickly tip off, i.e., fuse, the end of tubulation 9 so as to thereby seal the panel.

As can be seen, the glass plates 1 and 3 are positioned on platform 13, which is in turn mounted upon screws 15 and 17. As is evident, screws 15 and 17, which are mounted on pedestal 19, may be adjusted to appropriately raise or lower platform 13. Platform 13 is typically made of aluminum. Weights 21 and 23 are arranged to provide a uniform pressure upon plates 1 and 3 interposing seal frame 5. Weight 21 may be fabricated from steel, while weight 23 typically would be fabricated from aluminum. As shown, weights 21 and 23 have provided therein holes to accommodate tubulation 9 and heating element 7. In order to conveniently assemble the various parts on platform 13, the side walls and top portion of the controlled gas ambient furnace may be removed as a complete unit by uncoupling matching flanges 25 and 27. Any of a variety of techniques may be employed to couple flanges 25 to flange 27 so as to seal the internal chamber of the system.

In order to provide the heat necessary to effect the thermal cycle required in accordance with the process of the present invention, coil heater 29 is arranged to circumscribe the vertical wall of chamber 11. As shown, heater 31 is arranged above the panel assembly and heater 33 is arranged to provide heat from beneath the panel assembly. Gases are admitted at 35 and exhausted at 37. During those portions of the fabrication process where gas continuously passes through chamber 11, port 39 may more effectively be used to exhaust the gas. It is clear that any of a variety of systems may be arranged to be coupled to 35 so as to admit the various gases required to carry out the process in accordance with the principles of the present invention. Basically, a simple vacuum system is connected to 37 in order to evacuate the chamber of the furnace and the internal active region of the gas panel assembly. It should be appreciated that the system shown in the FIGURE is merely exemplary of a system that may be embodied to practice the process in accordance with the principles of the present invention, and that, as recognized by those skilled in the art, any of a variety of systems may readily be embodied to likewise practice the process in accordance with the present invention. In this regard, it is clear that different heating techniques may be utilized. Likewise, if necessary, cooling techniques may be utilized in order to cool certain regions of the furnace. It should also be appreciated that, although the system embodied in the FIGURE shows a single panel being fabricated, it is clear that the system may readily be enlarged to permit the simultaneous fabrication of a plurality of panels.

THE PROCESS

In accordance with the process of the present invention, the panel parts are placed in position on platform 13 shown in the FIGURE. As hereinabove mentioned, the "direct seal" technique may be employed whereby seal frame 5 is arranged such that the seal is made directly to the panel conductors and underlying plates 1 and 3. In this regard, the preformed seal frame may be fabricated from any of a variety of suitable solder glasses. In the preferred arrangement, tubulation 9 is preglazed with the solder glass such that the seal made between it and plate 1 is also carried out during the process of the present invention. By so doing, the possibility of impurities is reduced. In order to maintain a fixed spaced-apart relationship between panels 1 and 3 during sealing, spacers or shims may be positioned between the panels, as is well known to those skilled in the art. In this regard, nickel shims have been found to be particularly advantageous.

After the assembly has been positioned within chamber 11, heating element 7 is placed in position around the open end of tubulation 9. As hereinabove noted, a platinum coil has been found to be particularly useful for this purpose. With the panel assembly in place, the furnace is enclosed by positioning the integral side walls and cover over the panel such that flanges 25 and 27 meet and form a seal. The system is then evacuated by a sorption pump, or the like, connected to exhaust port 37. In this regard, a molecular sieve-liquid $N_2$ pumping arrangement may be used to pump out the system. It is clear that other pumping arrangements may as readily be employed.

After the system has been pumped down to, for example, $10^{-3}$ torr, the system is backfilled with purified air, i.e., dried, $CO_2$-free air, and then alternately evacuated and backfilled to a partial pressure in the range of 20 torr as the furnace is heated.

The chamber 11 with panel assembly is then rapidly heated to above the glass transition temperature of the seal glass used to form the seal frame. The heating rate is not critical, but it is evident that it should be such as to avoid thermal shock of the glass parts. Heating is accomplished by energizing heaters 29, 31 and 33. Typically, with conventional solder glass, the glass transition temperature is slightly in excess of 375° C. Accordingly, in the preferred mode, chamber 11 with panel assembly is heated to approximately 420° C to 460° C, and is held there for some time. Outgassing of panel parts and chamber is accomplished during this portion of the thermal cycle. One particular purpose in holding the temperature at between 420° C and 460° C is to fine the solder glass seal frame. This results in a much improved seal. It should be appreciated that the holding time for fining is not critical and may vary from an instant to one half hour, for example, depending upon the particular application involved. After the panel has been heated to 420° C–460° C and temporarily held thereat, the preferred mode of carrying out the process in accordance with the principles of the present invention involves evacuating furnace chamber 11 and backfilling with dried, $CO_2$-free air to 1 atmosphere and maintaining a continued flow of 100–200 cc/min from input port 35 to exhaust port 39. Under those conditions, the temperature is increased to approximately the seal temperature of the seal frame at a rate of approximately 100° C/hour. Where a solder glass seal frame is used, a temperature between 480° C and 520° C is adequate, 500° C being typical. When the temperature reaches for example, approximately 500° C, this temperature is held for approximately one hour to complete the edge seal and attachment of the tubulation to the panel. It should be noted that the end of tubulation 9 is still open to the furnace ambient in chamber 11. Thereafter, the chamber with its sealed panel parts is cooled to approximately 300° C at which temperature the chamber is evacuated and refilled to a partial pressure of the discharge gas desired to ultimately be encapsulated within the panel. In this regard, neon-0.1% argon has been found to be an effective gas for this purpose. The evacuate and refill procedure is successively repeated as the chamber and panel parts are cooled to a temperature where outgassing and the like from the panel parts has essentially terminated.

Where the conductive lines of the gas panel plates are covered with an evaporated-type dielectric glass, the outgassing caused by the tendency of the dielectric to release hydrogen terminates at about 200° C. Where a reflow dielectric is used as set forth in the above-cited Berkenblit et al patent, outgassing terminates at higher temperature levels of the cooling cycle and then the 200° C cooling level is not as significant.

After cooling the chamber with panel parts to a point where outgassing has ceased, the panel is ready for tip-off. At this point the pressure of the neon/argon gas, for example, is adjusted so that at room temperature the desired partial pressure of the gas exists in the encapsulated panel. Where, for example, the panel is cooled to 200° C, the pressure of the neon-0.1% argon mixture may be adjusted to a pressure of 635 torr, which pressure is equivalent to the desirable pressure of 400 at room temperature. At this temperature and pressure, tip-off is effected by energizing heating element 7. It is clear that the pressure and temperature chosen for tip-off is a matter of design choice, determined by the ultimate pressure desired in the panel at room temperature. The key constraint on temperature is that it be sufficiently low so that outgassing has terminated.

After tip-off, the panel is complete and ready to undergo testing and operation without any additional fabrication steps. As can be seen, the sequential, in situ operation described permits the sealing operation, the bakeout operation and the backfill operation to proceed within a single enclosure during a single thermal cycle without any separate intervention. With this mode of operation, bake-out and the like occurs on the way to arriving at a sealing temperature and backfilling occurs during cooling to the point where tip-off is executed.

It should be noted, that during the heating-up portion of the cycle, the dried $CO_2$-free air is admitted into the chamber in successive bursts of partial pressure. Thus the chamber is successively backfilled to a partial pressure and then evacuated. This acts as a dilution and viscous cleaning process whereby impurities and contaminants are loosened and removed from the internal surfaces of the chamber and surfaces of the gas panel assembly. This evacuation and backfill with the dried $CO_2$-free air may be effected many times up to the fining temperature, i.e., 460° C in the example described hereinabove.

Although reference has been made to using a dried $CO_2$-free air up through and including the sealing portion of the thermal cycle, it should be recognized that other gases, such as inert gases, may be utilized over this portion of the thermal cycle. For example, rather than a dried $CO_2$-free air, nitrogen, xenon and other rare gases may readily be employed. Alternatively, the neon/argon mixture used during the cooling portion of the cycle may also readily be used. It should be appreciated that the gas to ultimately be encapsulated within the gas panel is used over the entire evacuate-refill cooling portion of the thermal cycle to protect against the possibility that the successive evacuate-refill cycles used to remove outgassing may leave a residue of the ambient gas used for this purpose. If the ambient gas used for the evacuate-refill cycles is the same as that to be finally encapsulated within the panel, residue is not a problem.

Likewise, although operation of the process has thus far been described in terms of using dried $CO_2$-free air up through the sealing temperature and neon/argon for cooling, it is possible to use dried $CO_2$-free air up through the fining temperature and neon/argon for both the sealing and cooling portions of the cycle. By using inert gas during sealing, panels are produced which exhibit low operating voltages and small memory margins. In contradistinction, by using dried $CO_2$-free air during sealing, panels are produced which exhibit higher operating voltages and larger memory margins. It appears that the $O_2$ in the latter process is likely involved in the bulk stabilization of the dielectric layer and substrate of the panel, while $H_20$ and $CO_2$ have a deleterious effect thereon and should be avoided. During panel cooling and after tip-off, all of $O_2$, $H_2O$ and $CO_2$ should be avoided because of their potential effect upon the surface of the dielectric overcoat, such as MgO.

In regard to selection of the tip-off temperature and pressure, it should be recognized that the process in accordance with the present invention permits the judicious choice of these parameters such that optimum gas panels discharge operating conditions for a given panel may readily be selected. Thus, tipping off the panel tubulation may be at a chamber partial pressure and temperature such that the pressure for the panel at room temperature, for a predesigned sealed gap, lies in the region of minimum operating voltage on the Paschen curve. Likewise, as hereinabove mentioned, it is desirable that tip-off of the panel tubulation occur at a temperature where outgassing from the panel parts has terminated. Such temperature may readily be determined experimentally in accordance with the particular parts being used.

While the invention has been particularly shown and described with reference to preferred embodiments thereof, it will be understood by those skilled in the art that the foregoing and other changes in form and details may be made therein without departing from the spirit and scope of the invention.

What we claim is:

1. An in situ process for fabricating gas discharge display panels comprising;

placing unassembled gas panel parts, including panel opposing substrate glass plates having at least a dielectric layer, a layer of conductors, and a layer of secondary emissive material within the chamber of a controlled gas ambient furnace system, so that said plates are separated by a seal frame with at least one of said plates including tubulation means to permit passage of gas between said ambient and the region between said plates;

positioning tip-off means adjacent said tubulation means, so that tip-off may be effected in response to actuation external to said chamber;

initially evacuating said chamber to outgas surfaces therein;

admitting non-contaminating gas into said initially evacuated chamber;

heating said chamber to approximately the sealing temperature of said seal frame to seal said substrate plates together;

evacuating said chamber and sealed panel and admitting inert gas into said chamber and sealed panel after said chamber has at least cooled to a point where outgassing from said panel parts and chamber has terminated; and tipping off said tubulation means at a chamber partial pressure and temperature selected so that the panel is at the desired pressure for room temperature.

2. An in situ process as set forth in claim 1 wherein said step of heating comprises heating to a temperature just above the glass transition temperature of said sealing frame and holding that temperature to effect outgassing of panel parts and chamber prior to heating to said sealing temperature.

3. An in situ process as set forth in claim 2 wherein the said step of admitting gas into said initially evacuated chamber comprises admitting a dried $CO_2$-free air into said initially evacuated chamber.

4. An in situ process as set forth in claim 2 wherein said step of admitting gas into said initially evacuated chamber comprises admitting gas into said chamber in bursts to a partial pressure and evacuating while said chamber is heating.

5. An in situ process as set forth in claim 4 wherein said admitting to partial pressure and evacuating while said chamber is heating occurs over repetitive cycles.

6. An in situ process as set forth in claim 5 wherein said step of tipping off comprises tipping off said tubulation at a chamber partial pressure and temperature selected, so that the panel pressure at room temperature for the pre-designed sealed gap of said panel lies in the region of minimum operating voltage on the Paschen curve.

7. An in situ process as set forth in claim 6 wherein said step of admitting gas into said initially evacuated chamber comprises admitting dried, $CO_2$-free air into said initially evacuated chamber.

8. An in situ process as set forth in claim 7 wherein said step of evacuating said chamber and admitting said inert gas into said chamber while said chamber is cooling after said chamber has cooled to a point where outgassing from said panel parts and chamber has terminated comprises admitting a neon/argon gas mixture into said chamber.

9. An in situ process as set forth in claim 8 wherein said step of admitting a neon/argon gas mixture into said chamber while said chamber is cooling includes admitting a neon/argon gas mixture into said chamber and evacuating over the successive intervals.

10. An in situ process as set forth in claim 9 wherein said sealing temperature is between approximately 480° C and 520° C.

11. An in situ process as set forth in claim 10 wherein said seal temperature is held for approximately one hour.

12. An in situ process as set forth in claim 11 wherein said step of heating said chamber to approximately the sealing temperature of said seal frame comprises first heating to between approximately 420° C and 460° C and holding for at least several minutes before heating to approximately said sealing temperature.

13. An in situ process as set forth in claim 6 wherein said step of admitting gas into said initially evacuated chamber comprises admitting an inert gas into said initially evacuated chamber.

14. An in situ process as set forth in claim 7 wherein the said step of admitting dried, $CO_2$-free air comprises continually flowing dried, $CO_2$-free air through said chamber.

15. An in situ process as set forth in claim 14 wherein said step of evacuating said chamber and admitting said inert gas into said chamber while said chamber is cooling after said chamber has cooled to a point where outgassing from said panel parts and chamber has terminated comprises admitting said inert gas into said chamber while said chamber is cooling after said chamber has cooled to between 200° C and 300° C.

16. An in situ sequential process for fabricating gas discharge display panels comprising;

placing unassembled gas panel parts, including panel opposing substrate glass plates, within the chamber of a controlled gas ambient furnace system, so that said plates are separated by a seal frame with at least one of said plates including tubulation means to permit passage of gas between said ambient and the region between said plates;

positioning tip-off means adjacent said tubulation means, so that tip-off may be effected in response to actuation external to said chamber;

alternately evacuating and backfilling said chamber with a purified gas to a partial pressure as said chamber is heated up to outgas surfaces therein;

heating said chamber to just above the glass transition temperature of said seal frame, and holding for at least several minutes to effect outgassing of panel parts and chamber and fine said seal frame;

evacuating said chamber and backfilling with a purified non-contaminating gas and maintaining a continual flow of said gas through said chamber as said chamber is further heated up;

heating said chamber to the sealing temperature of said seal frame and holding said sealing temperature to seal said panel plates;

cooling said chamber after the sealing of said panel plates to a temperature where outgassing from said panel parts and chamber has terminated;

evacuating said chamber and sealed panel at a temperature equal to said temperature where outgassing has terminated or less and backfilling to a partial pressure with the discharge gas to be encapsulated within said panel; and tipping off said tubulation means at a chamber partial pressure and temperature selected so that the panel is at the desired pressure for room temperature.

17. An in situ sequential process as set forth in claim 16 wherein said step of evacuating said chamber and backfilling with a purified gas and maintaining a continual flow of said gas through said chamber comprises backfilling and maintaining a continual flow of neon/argon.

18. An in situ sequential process as set forth in claim 17 wherein said chamber is cooled to a pressure and temperature such that at room temperature the panel exhibits the desired encapsulated pressure and said tip-off means is then energized to encapsulate said discharge gas.

19. An in situ process as set forth in claim 18 wherein said purified gas is dried, $CO_2$-free air and said discharge gas is a neon/argon gas mixture.

* * * * *

UNITED STATES PATENT AND TRADEMARK OFFICE

CERTIFICATE OF CORRECTION

PATENT NO. : 4,018,490

DATED : April 19, 1977

INVENTOR(S) : M. Berkenblit, R. O. Lussow, K. C. Park, A. Reisman

It is certified that error appears in the above-identified patent and that said Letters Patent are hereby corrected as shown below:

Column 10, line 22, after "plates" insert --having at least a dielectric layer, a layer of conductors, and a layer of secondary emissive material--

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*